US006657143B2

(12) United States Patent
Nagashima

(10) Patent No.: US 6,657,143 B2
(45) Date of Patent: Dec. 2, 2003

(54) KEY SWITCH APPARATUS FOR ELECTRONIC MUSICAL INSTRUMENTS

(75) Inventor: Minoru Nagashima, Hamamatsu (JP)

(73) Assignee: Kabushiki Kaisha Suzuki Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/197,911

(22) Filed: Jul. 19, 2002

(65) Prior Publication Data

US 2003/0075431 A1 Apr. 24, 2003

(30) Foreign Application Priority Data

Oct. 19, 2001 (JP) ..... 2001-322599

(51) Int. Cl.[7] ..... H01H 1/28
(52) U.S. Cl. ..... 200/283; 200/535; 200/343
(58) Field of Search ..... 84/719, 744, 326, 84/423 R, 433; 200/5 A, 520, 530, 532, 534, 535, 246, 283, 341, 343

(56) References Cited

U.S. PATENT DOCUMENTS 3,480,744 A * 11/1969 Yamada ..... 200/1 A
3,534,196 A * 10/1970 Ohno ..... 200/281
3,555,228 A * 1/1971 Ohno ..... 200/535
3,622,729 A * 11/1971 Ohno ..... 200/246
3,993,883 A * 11/1976 Lindeberg ..... 200/283
4,055,734 A * 10/1977 Hayden ..... 200/5 A

* cited by examiner

*Primary Examiner*—Michael Friedhofer
(74) *Attorney, Agent, or Firm*—Jacobson Holman PLLC

(57) ABSTRACT

The size of the key switch apparatus, particularly its height, is reduced to allow its use even in keyboard-type electronic musical instruments. By virtue of a key-driven actuator, multiple terminal strips are allowed to contact bus bars installed in more than one stage so as to produce multiple tones simultaneously. In this key switch apparatus, the multiple bus bars are installed, being shifted in location in their respective stages, and multiple terminal strips are also installed in each stage so that they may contact the individual bus bars individually. In addition, the actuator has a terminal-strip engaging means for controlling the movements of the multiple terminal strips.

5 Claims, 3 Drawing Sheets

KEY SWITCH APPARATUS FOR ELECTRONIC MUSICAL INSTRUMENTS

BACKGROUND OF THE INVENTION

1. Field of the Invention

This invention relates to a key switch apparatus for use in electronic musical instruments having a structure in which multi-stage bus bars are allowed to contact multiple terminal strips by a key-driven actuator so as to produce multiple tones simultaneously.

2. Description of the Prior Art

Some electronic musical instruments equipped with a key switch apparatus that is turned on and off by key operation have bus bars vertically tensioned in multiple stages to produce multiple tones, such as 16', 8', 4', 22/3' and 2', simultaneously. Bus bars are installed under the keys, extending from the bottom bass key to the top treble key. On the side of the actuator moved by key operation, there are terminal strips that will contact the bus bars. These terminal strips are pushed onto the bus bars almost simultaneously by key depression to provide signal current. Such a key mechanism tends to be too high, and electronic musical instruments equipped with this mechanism tend to be bulky. The mechanism also has the disadvantage of being too thick to be installed in a flat one-stage keyboard. In addition, due to the huge number of switch circuits, wiring work is time-consuming and lowers productivity.

SUMMARY OF THE INVENTION

This invention has been made to solve the above problems, and its object is therefore to downsize the key switch apparatus, particularly its height, and to provide a key switch apparatus sufficiently compact to be adopted in keyboard-type electronic musical instruments. The other object of the present invention is to eliminate complex wiring work by, for example, forming the key switch mechanism into a single unit for each key so as to improve productivity.

The above and other objects have been attained by installing multiple bus bars with intervals in each stage, multiple terminal strips that can contact the bus bars individually in each stage, and a terminal-strip engaging means for controlling the movements of the terminal strips in the actuator. Further, this invention also can provide a key switch apparatus for electronic musical instruments characterized in that the apparatus has: a mounting frame having multiple through-holes for bus bars in each stage and being installed under each key; an actuator having engaging windows through which multiple terminal strips penetrate and being installed so that it can move vertically in the mounting frame and can reach a key at the top of the frame; and a printed circuit board that has terminals for connection to the ends of the multiple terminal strips; and an electric circuit that obtains signal current corresponding to multiple tones to be produced simultaneously.

The key switch apparatus set forth in this invention is to be employed in electronic musical instruments, specifically electronic keyboard musical instruments, and, in principle, this apparatus has a structure in which multi-stage bus bars are allowed to contact multiple terminal strips by a key-driven actuator so as to produce multiple tones simultaneously.

For example, a conventional electronic organ may have ten bus bars arrayed in ladder form, each having a corresponding terminal strip wired to a circuit. Then, such bus bars occupy significant installation space, and a large number of wires, approximately 2000 in this case, must be handled for electric connection. Conventionally, ten bus bars are arrayed individually in ten stages, so that each terminal strip contacts the corresponding bus bar. This conventional basic structure is regarded in the invention as a technological problem.

In the present invention, multiple bus bars are shifted in location in each stage. If more than one bus bar can be installed in each stage, the necessary number of stages decreases accordingly to a fraction of the number of bus bars installed in each stage. For example, ten stages of bus bars (one bus bar each) can be decreased by half, to five stages, if each stage has two bus bars. The locations of bus bars may be shifted in any direction, according to their configuration for installation. For example, the bus bars tensioned along laterally-arranged natural keys should be shifted ahead and behind in location. In addition, they may be shifted vertically at the same time.

Multiple terminal strips are installed in each stage so that they will contact the individual bus bars. Each terminal strip is located so as to contact each of the bus bars shifted in location in each stage. For example, when multi-stage bus bars are shifted in location ahead and behind in each stage, the corresponding multiple terminal strips are installed, with their locations shifted laterally, in each stage.

An engaging mechanism for contact with terminal strips is installed in an actuator so as to control the key-driven movement of the terminal strips. The actuator may be of any type, provided that it moves in accordance with key depression to move and contact the terminal strips with bus bars. The actuator of the invention, however, has an engaging means for controlling the movement of the multiple terminal strips. By virtue of this mechanism, the distances between the individual bus bars and corresponding terminal strips become almost equal, and it thereby allows the terminal strips to contact the bus bars that have been shifted to predetermined positions almost simultaneously. This effect is obtained, for example, by providing a difference in height in the area where the actuator contacts the terminal strips.

In such a key switch apparatus for electronic musical instruments, its mounting frame may have through-holes for bus bars and an installation space for the actuator. This mounting frame limits the locations of bus bars and the movement of the actuator against the bus bars, so that the terminal strips may contact the bus bars almost simultaneously. The ends of the multiple terminal strips may be connected to a printed circuit board. The printed circuit board has a circuit, for example, that obtains signal current corresponding to multiple tones that will be produced simultaneously. Then, because wiring is completed simply by coupling the printed circuit board with the mounting frame, the key switch apparatus can be made into a single unit for each key, and thereby its structure can be significantly simplified. If the key switch unit module is made equal to or smaller than the width of a key, it becomes sufficiently compact to be installed beneath each key.

DETAILED DESCRIPTION OF THE PREFERRED EMBODIMENTS

Figure 1:
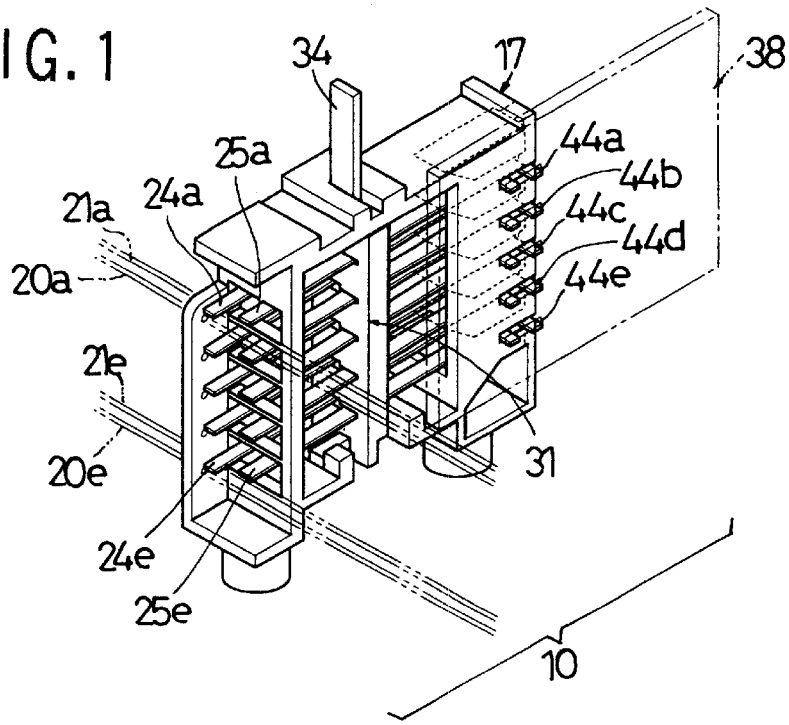
FIG. 1 is a perspective view of the key switch apparatus for electronic musical instruments according to an embodiment of the present invention.
Figure 2:
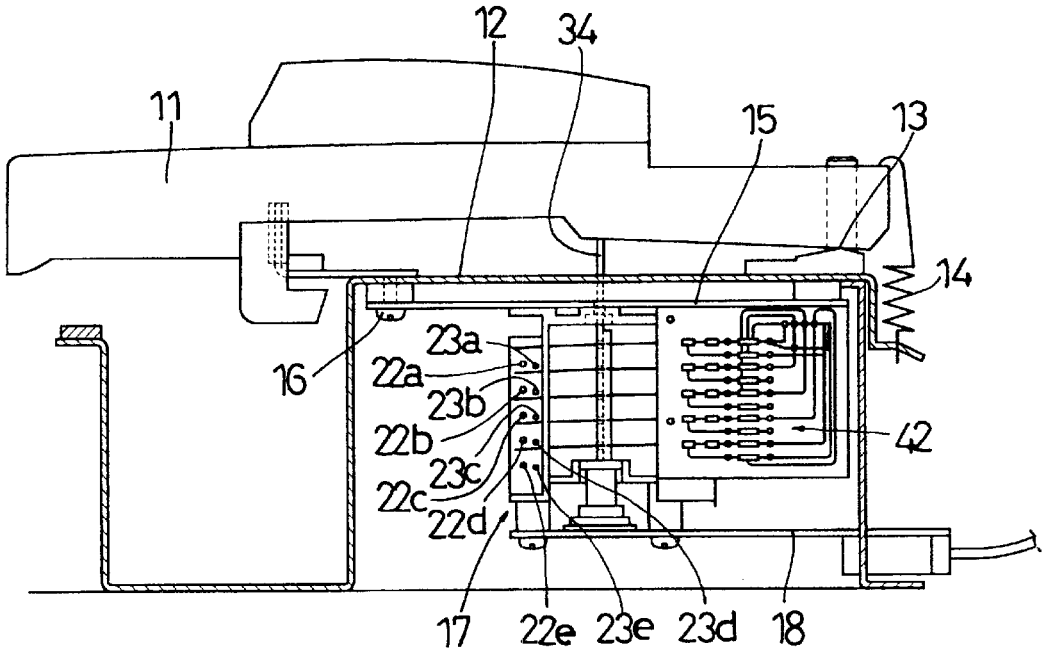
FIG. 2 is a sectional view illustrating the relationship between the key switch apparatus of the invention and the keyboard.

The present invention will now be described in detail in specific embodiments, with reference to the accompanying drawings. FIG. 1 shows the key switch apparatus 10 for electronic musical instruments according to the present invention that will be installed under the keyboard as shown in FIG. 2.

A natural key (white key) 11 of the keyboard is supported at its back end at the supporting point 13 on a chassis 12, and a natural key spring 14 provides an upward force for the key's front end. This force provides an appropriate resistance during key depression. Under the chassis 12, a mounting board 15 is held by a fastener 16, and under the mounting board 15 is installed the mounting frame 17 of the key switch apparatus 10 of the invention. The mounting frame 17 is supported from the bottom side by a supporting unit 18.

Figure 3:
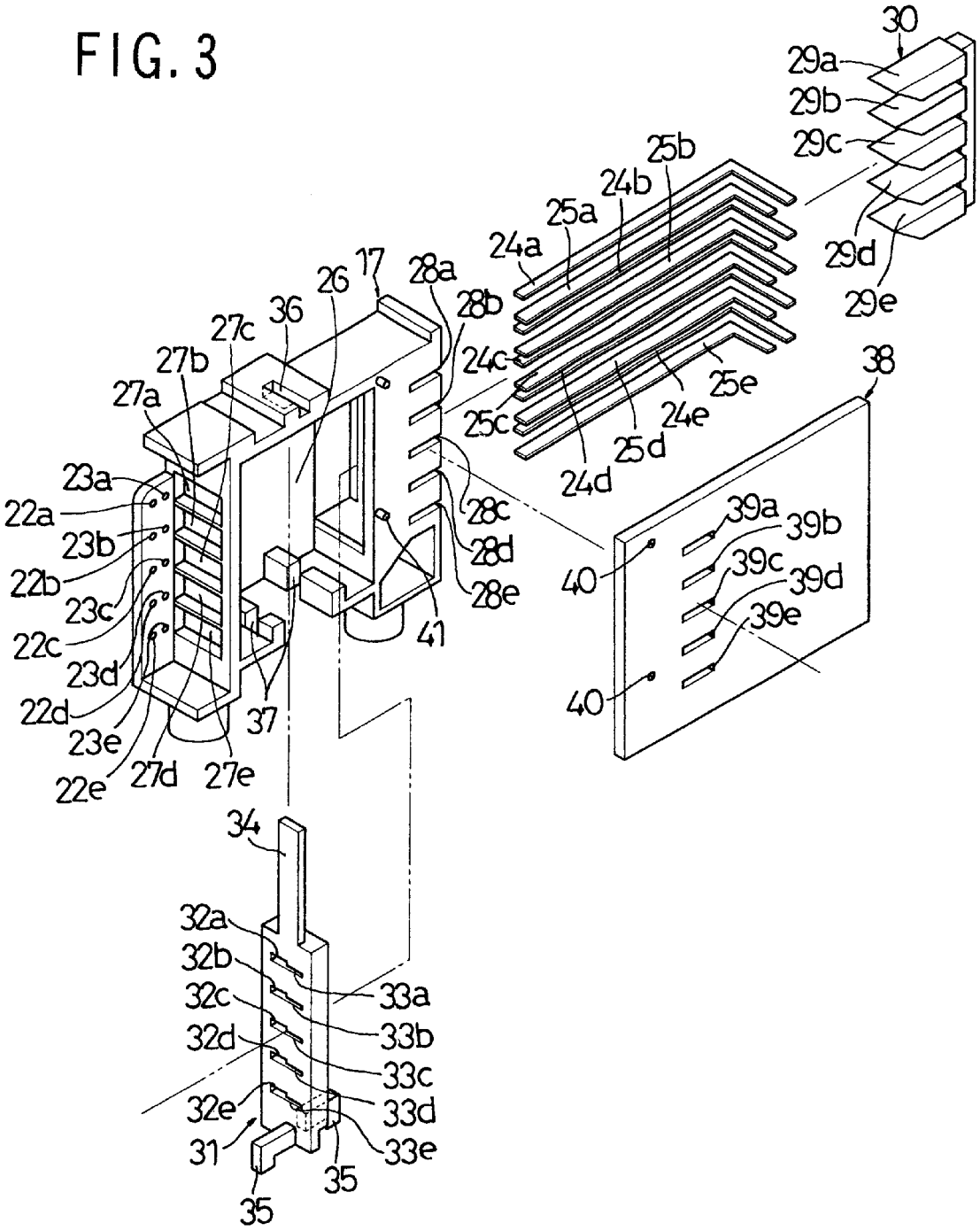
FIG. 3 is an exploded perspective view of the key switch apparatus of the invention.

The mounting frame 17 has through-holes 22*a*, 23*a* . . . 22*e*, 23*e* in its side wall on the front side, through which run five stages of bus bars 20*a*, 21*a* . . . 20*e*, 21*e* that are shifted ahead and behind in two rows. Behind the side wall is an installation space 26 for terminal strips 24*a*, 25*a* . . . 24*e*, 25*e*. Between the side wall and the installation space are windows 27*a*–27*e* (FIG. 3) where terminal strips 24*a*–25*e* will penetrate in each stage. The terminal strips 24*a*–25*e* are the pairs of resilient metal strips. Their back ends, bent at almost right angles, are located in windows 28*a*–28*e* formed in the rear of the mounting frame 17. The terminal strips are secured in the mounting frame 17 by fitting a fastener 30 having fitting strips 29*a*–29*e* into the individual windows 28*a*–28*e*.

The right-hand and left-hand terminal strips 24*a*–25*e* are fitted in an actuator 31 that will be installed, movably in the vertical direction, in the installation space 26 in the mounting frame 17. For this purpose, the actuator 31 has the same number of slits as that of terminal strips. Each slit is further divided into high and low slits; the high slits 32*a*–32*e* restrict the movement of terminal strips 24*a*–24*e* facing the front bus bars 22*a*–22*e*, while the low slits 33*a*–33*e* restrict the movement of terminal strips 25*a*–25*e* facing the rear bus bars 23*a*–23*e*. Thereby, the high slits 32*a*–32*e* and low slits 33*a*–33*e* provide an engaging mechanism for the terminal strips 24*a*–24*e* and 25*a*–25*e*.

The actuator 31 has a part 34 extending upward and a guide protrusion 35 in the bottom. The part 34 reaches the natural key 11 through a guide hole 36 formed in the top of the mounting frame 17, serving as the part of the unit that transfers the downward force produced by key operation. The guide protrusion 35 is mated with a groove 37 formed in the bottom of the mounting frame 17 to stabilize the movement of the actuator 31. The terminal strips 24*a*–25*e* are designed so that their resilient force may be exerted upward in windows 27*a*–27*e* when they are assembled in a unit module. Then, their fixed back ends are located higher than the high slits 32*a*–32*e* and low slits 33*a*–33*e*, and at the same time, the front windows 27*a*–27*e* are located lower than the high and low slits.

The mounting frame 17 is coupled with a printed circuit board 38. The printed circuit board 38 has terminals 39*a*–39*e* for connection with the terminal strip ends 44*a*–44*e* projecting from the back end of the mounting frame 17. These terminals are both electrically and mechanically connected to the terminal strip ends 44*a*–44*e* by soldering, for example. In addition, fitting mechanisms 40, 41 are installed in proper positions in order to structurally consolidate the printed circuit board 38 and the mounting frame 17. The printed circuit board 38 has a printed circuit 42 that is necessary to obtain the signal current corresponding to multiple tones to be produced, thus eliminating the need for wiring to the circuit. Each key has 20 wires in a conventional case in which ten bus bars are installed in ten stages. The present invention provides the great advantage of eliminating the wiring of such a huge number of signal lines.

Figure 4:
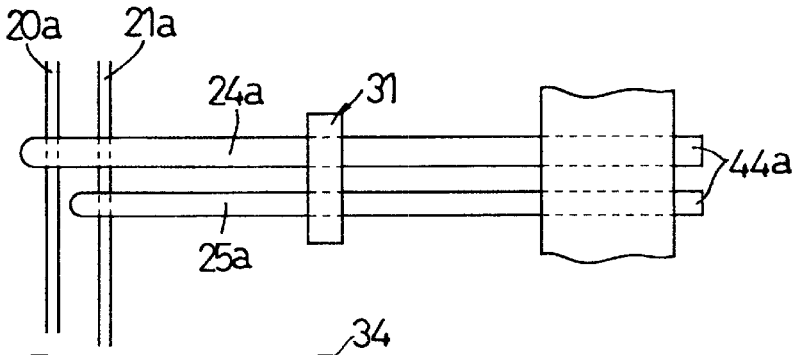
FIG. 4 is a plan view illustrating the relationship between the bus bars and terminal strips.

The key switch unit of this structure is used in the state shown in FIG. 1. Thus, for electronic musical instruments, the number of key switch units to be assembled may be the same as the number of keys. The bus bars 20*a*–21*e* may be guided into through-holes 22*a*–23*e* after all or part of the components have been assembled. As a result, overall productivity can be significantly increased. The bus bars 20*a*–21*e* and terminal strips 24*a*–25*e*, as well as the actuator 31, comprise the structure shown in FIG. 4.

Figure 5:
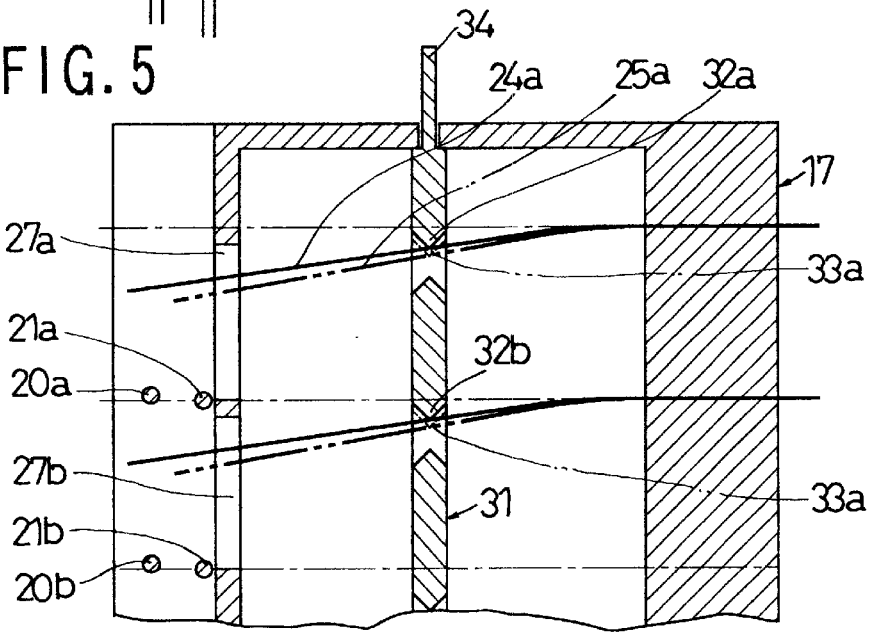
FIG. 5 is a side sectional view illustrating the relationship between the bus bars and terminal strips before the key is depressed.
Figure 6:
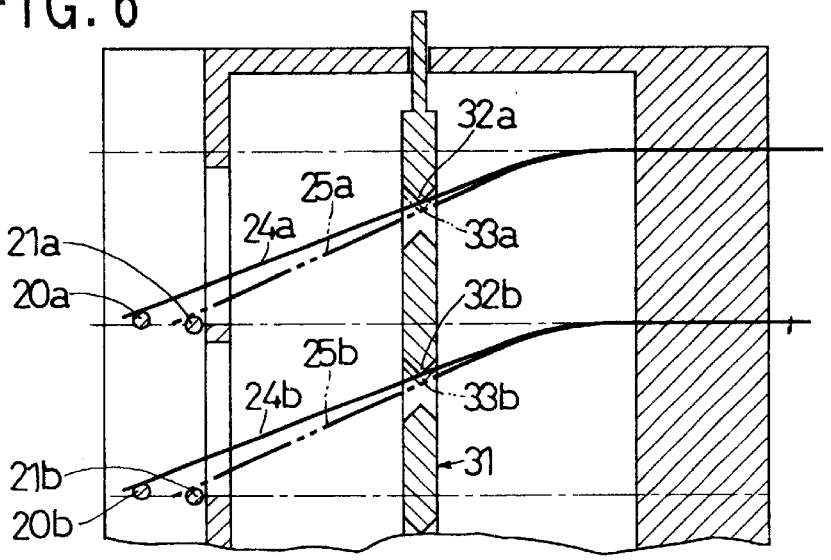
FIG. 6 is a side sectional view illustrating the relationship between the bus bars and terminal strips when the key is depressed.

The exemplified bus bars 20*a*–21*e* are both slightly shifted in location, ahead and behind and vertically, while the terminal strips 24*a*–25*e* are fixed at their ends 44*a*–44*e* and located in the specific positions controlled by the high slits 32*a*–32*e* and lower slits 33*a*–33*e* of the actuator 31 (FIG. 5). In this configuration, by virtue of these differences in the height of the slits, the respective distances between the terminal strips 24*a*–25*e* and bus bars 20*a*–21*e* become almost equal. As a result, the times required for the terminal strips 24*a*–25*e* to reach the bus bars 20*a*–21*e* become almost equal when the actuator 31 is pressed down by the key. Accordingly, all terminal strips 24*a*–25*e* may contact all bus bars 20*a*–21*e* simultaneously (FIG. 6).

Musical effects provided by bus bars 20*a*–21*e* can also be obtained through the use of IC controllers. In such a case, the clarity and combination of tones can be controlled more precisely. The present invention, which preserves part of the mechanical structure to simplify the contact structure, can provide musical effects of high quality and stability.

The above-discussed structure and effects of the present invention reduce the height of the key switch apparatus to at least half the conventional height. This makes it easy to employ this key switch apparatus, even in keyboard-type electronic musical instruments. Moreover, because the key switch apparatus can be installed in each key as an individual unit and each unit has a printed circuit board, the wiring of thousands of wires, which was necessary in the prior art, can be eliminated, and thereby productivity is significantly improved. In addition, although it was necessary in the prior art to locate failures, if any, among thousands of wires, this invention eliminates such trouble-shooting work, thereby providing easier maintenance and higher reliability.

What is claimed is:

1. A key switch apparatus or use in electronic musical nstruments, said key switch apparatus comprising:

multiple bus bars contacting multiple terminal strips by a key-driven actuator so as to produce multiple tones simultaneously, said multiple bus bars being installed at intervals in a stage, the multiple terminal strips being installed so as to contact said multiple bus bars individually in the stage, and a terminal-strip engaging means for controlling movements of said multiple terminal strips installed in said actuator.

2. The key switch apparatus according to claim 1, wherein said multiple bus bars are shifted vertically in location in the stage, and said multiple terminal strips are shifted laterally in location in the stage.

3. The key switch apparatus according to claim 1, wherein portions of the terminal-strip engaging means differ in height and individual distances between said multiple bus bars and the terminal strips are almost equal so that said multiple terminal strips may contact said multiple bus bars simultaneously.

4. A key switch apparatus for use in electronic musical instruments in which multi-stage bus bars are allowed to contact multiple terminal strips by a key-driven actuator so as to produce multiple tones simultaneously, the key switch apparatus comprising:

a mounting frame having multiple through-holes for the bus bars in each of the stages;

an actuator having engaging windows through which said multiple terminal strips penetrate and being installed so that the actuator can vertically move in said mounting frame and reach a key in a top of the frame;

a printed circuit board having terminals for connection to ends of said multiple terminal strips; and an electric circuit that removes signal current corresponding to multiple tones to be produced simultaneously.

5. The key switch apparatus according to claim 4, wherein said mounting frame and said printed circuit board are consolidated into a unit by a mechanical fitting means for fitting said printed circuit board into said mounting frame with a fastener accepting said multiple terminal strips with a width of said unit being equal to or smaller than a width of the key.

* * * * *